US005704168A

United States Patent [19]

Barasch

[11] Patent Number: 5,704,168

[45] Date of Patent: Jan. 6, 1998

[54] METHOD AND APPARATUS FOR THERMAL INSULATION OF BUILDINGS

[76] Inventor: Robert Barasch, Rte. 1, Plainfield, Vt. 05667

[21] Appl. No.: 707,747

[22] Filed: Sep. 5, 1996

[51] Int. Cl.[6] ..... E04H 15/20

[52] U.S. Cl. ..... 52/2.23; 52/2.25; 135/900

[58] Field of Search ..... 52/2.16, 2.17, 52/2.19, 2.21, 2.22, 2.23, 2.25, 2.24; 135/900, 901, 902

[56] References Cited

U.S. PATENT DOCUMENTS 3,936,984 2/1976 Yando ..... 52/2.25 X
4,257,199 3/1981 Kuboyama ..... 52/2.19 X
4,685,484 8/1987 Moneta ..... 135/900 X
5,062,234 11/1991 Green ..... 135/901 X

*Primary Examiner*—Carl D. Friedman
*Assistant Examiner*—Yvonne Horton-Richardson
*Attorney, Agent, or Firm*—Choate, Hall & Stewart

[57] ABSTRACT

Thermal insulating structure having at least two layers of a substantially gas-impervious material forming a gas-retaining enclosure having a plurality of segments. The segments are connected by non-inflatable substantially flat structure. A valve is mounted in each segment for inflating and deflating the segment. Means are provided for securing the thermal insulating structure around the perimeter of a building to be insulated.

7 Claims, 1 Drawing Sheet

METHOD AND APPARATUS FOR THERMAL INSULATION OF BUILDINGS

BACKGROUND OF THE INVENTION

This invention relates to a thermal insulating system and more particularly to an air filled enclosure for surrounding portions of a building.

At present, many people in northern climates take steps each year at the approach of winter to insulate and/or protect against wind the interface between a building's foundation and the superstructure that rests on the foundation. Because foundations and superstructures are typically made of different materials such as, for example, concrete and wood respectively, there can be excessive heat loss at the interface because of inadequate sealing. In the past, homeowners have covered this interface with materials such as tar paper, polyethylene sheets, metal flashing, baled or loose hay or straw, wood shavings, leaves, branches, etc. Some of these materials offer protection against winds, while others offer some insulating qualities. All of these materials have to be removed in the spring both for aesthetic reasons and to prevent rotting of wooden components. Many of the prior art materials used in this fashion cannot be used for a second winter season and are thus inefficient.

SUMMARY OF THE INVENTION

The thermal insulating structure of the invention includes at least two layers of a substantially gas impervious material forming a gas-retaining enclosure including a plurality of segments. A non-inflatable, substantially flat structure joins the segments of the enclosure. A valve is mounted in each segment for inflating and deflating the segment. Pegs or stakes are provided for securing the thermal insulating structure around the perimeter of the building to be insulated.

In preferred embodiments, the gas is air which is pumped into each segment of the enclosure. Suitable substantially gas impervious material is plastic such as polyethylene. The pegs or stakes may be plastic, wood or metal.

In another aspect, the invention is a method for insulating the interface between the foundation and the superstructure of a building. The method includes placing a multi-segmented, inflated structure in contact with the interface and overlapping at least a part of the foundation and the superstructure. The multi-segmented, inflated structure is then secured into contact with the interface. It is preferred that the structure of the invention be placed into contact with the interface and secured in position before inflation. After the structure is in place, a pump or other suitable inflation device is utilized to inflate the segments.

By wrapping the thermal insulating structure of the invention around a building at the interface between foundation and superstructure, heat loss is greatly reduced. Heat loss reduction comes about by minimizing air leaks between foundation and superstructure and also by retarding heat flow by conduction by virtue of the insulating quality of a volume of gas such as air. The structure of the invention may be custom fit to a particular building or dwelling and is reusable winter season after winter season.

DESCRIPTION OF THE PREFERRED EMBODIMENT

Figure 1:
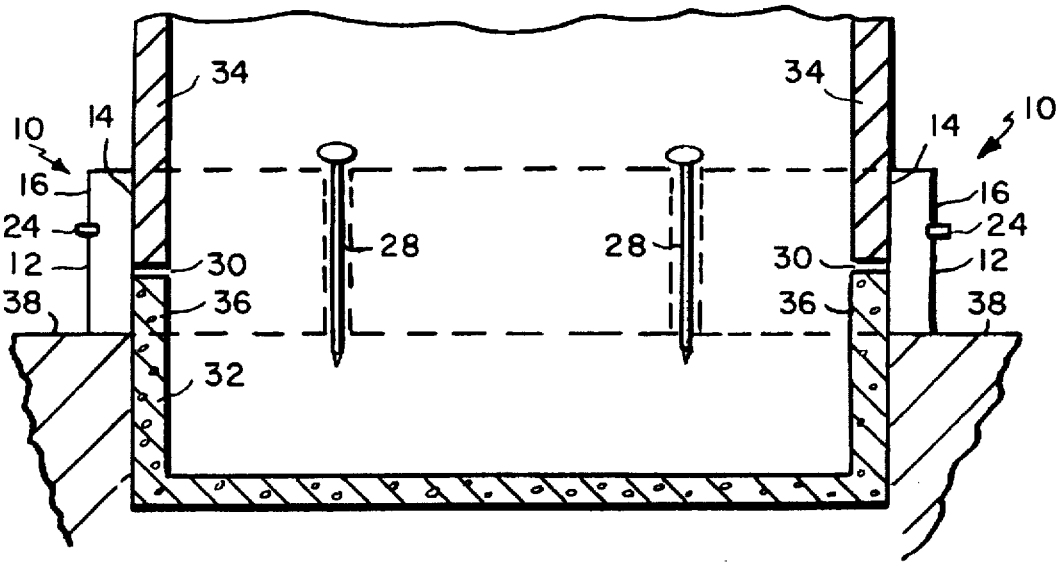
FIG. 1 is a cross-sectional, schematic view of the system of the invention.
Figure 2:
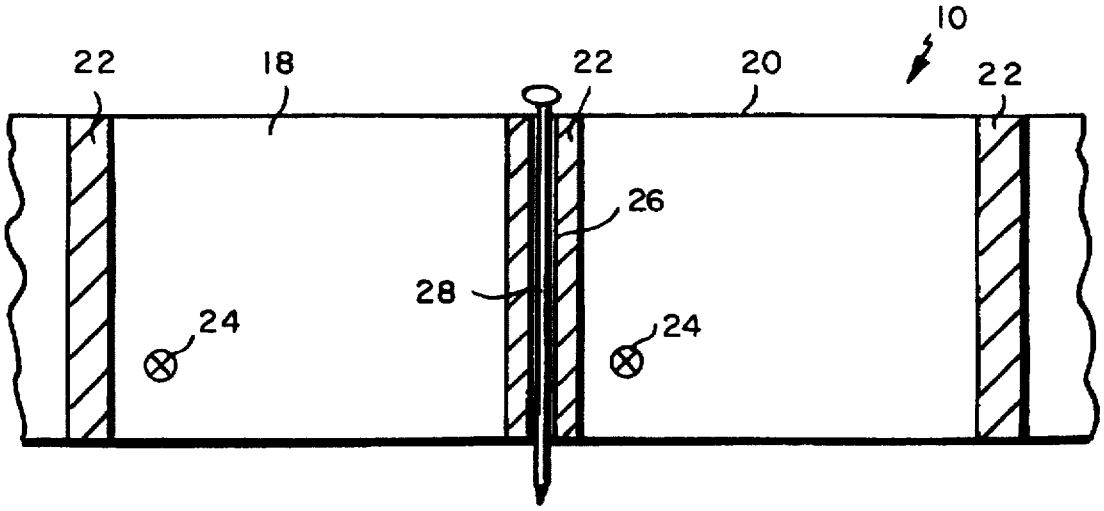
FIG. 2 is a side view of the thermal insulating structure of the invention.

With reference to FIGS. 1 and 2, the thermal insulating structure 10 of the invention (known as "Air Blanket™") includes first and second layers 12 and 14 of a substantially gas impervious material such as a plastic material. One suitable material is polyethylene 0.625 inches thick. The layers 12 and 14 are configured to form an enclosure for retaining a gas 16 such as air. As shown in FIG. 2, the structure of the invention includes a plurality of segments 18 and 20 which are separated by a non-inflatable portion 22. For custom fitting, additional portions 22 may be formed by shortening the segment 18, utilizing a laminating press (not shown) to adhere the layers 12 and 14 together. Because of the separating portion 22, each of the segments such as segments 18 and 20 requires a separate valve 24 for inflating and deflating a segment. A pump such as a hand or foot operated pump (not shown) is suitable for inflating the segments. Alternatively, a source of a compressed gas can also be used. As shown in FIG. 2, the separating portion 22 may include a pocket 26 through which a peg or stake 28 may be inserted and then driven into, for example, the ground.

As shown in FIG. 1, the thermal insulating structure 10 of the invention is placed around an interface 30 between, for example, a concrete foundation 32 and a superstructure 34 which forms the rest of a building. As shown, the insulating structure 10 overlaps a portion 36 of the foundation 32 which is above ground level 38 and the corresponding portion of the superstructure 34. It is contemplated that the thermal insulating structure 10 will be manufactured in different heights ranging from eighteen to thirty-six inches to provide adequate overlap. It is also contemplated that the structure of the invention will be provided in rolls permitting distributors to sell them in lengths that will reach around the perimeters of buildings of various sizes and foundation configurations.

In use, the structure 10 in an uninflated condition is wrapped around a building overlapping foundation and superstructure. The uninflated portions 22 are useful at corners. Along straight portions of a building, the portions 22 may be folded under so that inflated portions are always in contact with the building. Pegs or stakes 28 are then used to secure the structure into intimate contact with the building. It is preferred that the pegs 28 be driven with a hammer into the ground. If that is not possible because of, for example, concrete apron-work, or ledge at the perimeter of the building, other means of attachment may be utilized. Each segment is inflated either before or after the structure is secured by means of the pegs 28 through the valves 24. Internal structure (not shown) may be provided between the layers 12 and 14 to prevent excessive ballooning of the insulating structure upon inflation.

The Air Blanket™ of the invention is readily installed by a single person with a hammer and air pump which may be manually operated. A laminating press can be used if desired to alter segment lengths for accomodating corners. The valves 24 may be conventional valves used with respect to inflatable boats, sporting equipment, beach toys, etc. At the end of the winter season, the valves are released so as to allow the segments to deflate. After pegs 28 are removed, structure may be rolled up for convenient storage until used again the following winter.

What is claimed is:

1. Thermal insulating structure comprising:

at least two layers of a substantially gas-impervious material forming a gas-retaining enclosure including a plurality of segments;

a non-inflatable, substantially flat portion adapted to join segments of the enclosure;

a valve mounted in one of the at least two layers in each segment for inflating and deflating the segment; and means for securing the thermal insulating structure around the perimeter of a building to be insulated at an interface between a foundation and a superstructure of the building.

2. The thermal insulating structure of claim 1 wherein the gas is air.

3. The thermal insulating structure of claim 1 wherein the gas-impervious material is plastic.

4. The thermal insulating structure of claim 3 wherein the plastic material is polyethylene.

5. The thermal insulating structure of claim 1 wherein the securing means comprises at least one peg to be driven into the ground.

6. Method for insulating the interface between a foundation and the superstructure of a building comprising:

placing a multi-segmented, inflated structure into contact with the interface and overlapping at least a part of the foundation and the superstructure; and securing the multi-segmented, inflated structure into contact with the interface.

7. The method of claim 6 wherein the structure is inflated with air.

* * * * *